US007563332B2

(12) United States Patent
Fleury et al.

(10) Patent No.: US 7,563,332 B2
(45) Date of Patent: Jul. 21, 2009

(54) METALLIC GLASS WITH NANOMETER-SIZED PORES AND METHOD FOR MANUFACTURING THE SAME

(75) Inventors: Eric Fleury, Seoul (KR); Yu-Chan Kim, Koyang (KR); Ki-Bae Kim, Seoul (KR); Jayamani Jayaraj, Seoul (KR); Do-Hyang Kim, Seoul (KR); Byung-Joo Park, Seoul (KR)

(73) Assignee: Korea Institute of Science and Technology, Hawolgok-dong, Seongbuk-gu, Seoul (KR)

( * ) Notice: Subject to any disclaimer, the term of this patent is extended or adjusted under 35 U.S.C. 154(b) by 150 days.

(21) Appl. No.: 11/562,572

(22) Filed: Nov. 22, 2006

(65) Prior Publication Data

US 2007/0267111 A1 Nov. 22, 2007

(30) Foreign Application Priority Data

May 19, 2006 (KR) ..... 10-2006-0045204

(51) Int. Cl.
*C22C 45/10* (2006.01)

(52) U.S. Cl. ..... 148/403; 148/421; 420/418

(58) Field of Classification Search ..... 148/403; 420/418

See application file for complete search history.

(56) References Cited

U.S. PATENT DOCUMENTS

| | | | | |
|---|---|---|---|---|
| 6,623,566 | B1 * | 9/2003 | Senkov et al. | 148/121 |
| 7,361,239 | B2 * | 4/2008 | Zahrah et al. | 148/561 |
| 2006/0054250 | A1 * | 3/2006 | He et al. | 148/421 |
| 2006/0231169 | A1 * | 10/2006 | Park et al. | 148/403 |

FOREIGN PATENT DOCUMENTS

| | | |
|---|---|---|
| JP | 10-097857 | 1/2006 |
| KR | 1019970062057 | 9/1997 |

OTHER PUBLICATIONS

A. Gebert et al., "Corrosion behaviour of the Mg65Y10Cu15Ag10 bulk metallic glass", Materials Science and Engineering A, vols. 375-377, Jul. 15, 2004, pp. 280-284.

A. Gebert et al., "Hot water corrosion behaviour of Zr-Cu-Al-Ni bulk metallic glass", Materials Science and Engineering A, vol. 316, Issues 1-2, Nov. 15, 2001, pp. 60-65.

* cited by examiner

*Primary Examiner*—George Wyszomierski

(57) ABSTRACT

A nanometer-sized porous metallic glass and a method for manufacturing the same are provided. The porous metallic glass includes Ti (titanium) at 50.0 at % to 70.0 at %, Y (yttrium) at 0.5 at % to 10.0 at %, Al (aluminum) at 10.0 at % to 30.0 at %, Co (cobalt) at 10.0 at % to 30.0 at %, and impurities. Ti+Y+Al+Co+the impurities=100.0 at %.

4 Claims, 16 Drawing Sheets

METALLIC GLASS WITH NANOMETER-SIZED PORES AND METHOD FOR MANUFACTURING THE SAME

CROSS-REFERENCES TO RELATED APPLICATION

This application makes reference to, incorporates the same herein, and claims all benefits accruing under 35 U.S.C.§119 from an application earlier filed in the Korean Intellectual Property Office on May 19, 2006 and there duly assigned Serial No. 10-2006-00045204.

BACKGROUND OF THE INVENTION (a) Field of the Invention

The present invention relates to metallic glass with nanometer-sized pores and a method for manufacturing the same, and more particularly, to metallic glass with nanometer-sized pores that includes two interconnected amorphous phases and a method for manufacturing the same.

(b) Description of the Related Art

Porous materials contain a plurality of pores. The porous materials are already encountered in almost all fields of everyday life, from hygienic products, textiles, filters, insulating materials, in addition to components in many industrial production processes.

The basic characteristics of the porous materials depend on their porous microstructure which determines macroscopic properties such as thermal conductivity, moisture absorption ability, filtering efficiency, and soundproofing efficiency. Various techniques have been developed to produce materials with pores of a controlled size down to a few Angstroms, such as zeolites that are referred to as microporous materials. In particular, mesoporous materials with a pore size between 2 nm to 50 nm and macroporous materials with a pore size larger than 50 nm have been developed for several years for polymer and ceramic materials.

Particularly, materials with a controlled size of pores at a nanometer range have been developed, which provide distinctive properties. One of the major achievements of nanotechnology is the design of materials with a porous structure to provide a high surface area-to-volume aspect ratio.

Using nanotechnology, attempts have been made for the last ten years to develop porous metallic glass. Metallic glass is a homogeneous material with an aperiodic structure such as grain depletion and segregation. Metallic glass has good properties such as high specific strength, high corrosion resistance, and low thermal conductivity. In contrast to conventional metallic materials, the metallic glass has a regular crystalline structure consisting of single crystal grains of varying sizes that are suitable to form the microstructure.

Porous metallic glass is metallic glass with a plurality of pores. The porous metallic glass is made by combining the advantages of porous materials and metallic glass, i.e., a large surface-to-volume aspect ratio and high strength.

However, the conventional method has encountered difficulty owing to the limitation imposed by the necessary minimum glass forming ability of the alloys. Moreover, the size of the pores could not be reduced thus far below a few micrometers. Particularly, porous metallic materials with a pore size of a nanometer range have not previously been manufactured. Furthermore, the presence of pores results in a significant reduction of the strength of metallic materials and limits their application.

SUMMARY OF THE INVENTION

In order to solve the aforementioned problems, the present invention provides porous metallic glass including two amorphous phases.

In addition, the present invention provides a method for manufacturing the aforementioned porous metallic glass.

According to an aspect of the present invention, the porous metallic glass includes Ti (titanium) at 50.0 at % to 70.0 at %, Y (yttrium) at 0.5 at % to 10.0 at %, Al (aluminum) at 10.0 at % to 30.0 at %, Co (cobalt) at 10.0 at % to 30.0 at %, and impurities. Ti+Y+Al+Co+the impurities=100.0 at %.

The glass may include two or more separated and interconnected amorphous phases. The first amorphous phase of the two or more amorphous phases may be a $Ti_{56}Al_{24}Co_{20}$ amorphous phase, and the second amorphous phase may be a $Y_{56}Al_{24}Co_{20}$ amorphous phase. The $Ti_{56}Al_{24}Co_{20}$ amorphous phase may be present in a range from 50.0 at % to 80.0 at %, and the $Y_{56}Al_{24}Co_{20}$ amorphous phase may be present in a range from 20.0 at % to 50.0 at %.

A plurality of pores formed in the porous metallic glass may be formed by removing Y elements from the $Y_{56}Al_{24}Co_{20}$ amorphous phase. Pores formed in the porous metallic glass may have sizes in a range from 10 nm to 500 nm.

According to another aspect of the present invention, the porous metallic glass include Zr (zirconium) at 50.0 at % to 70.0 at %, Y at 0.5 at % to 10.0 at %, Al at 10.0 at % to 30.0 at %, Co at 10.0 at % to 30.0 at %, and impurities. Zr+Y+Al+Co+the impurities=100.0 at %.

The glass may include two or more interconnected amorphous phases. The first amorphous phase of the two or more amorphous phases may be a $Zr_{55}Al_{20}Co_{25}$ amorphous phase, and the second amorphous phase may be a $Y_{56}Al_{24}Co_{20}$ amorphous phase. The $Zr_{55}Al_{20}Co_{25}$ amorphous phase may be present in a range from 45.0 at % to 55.0 at %, and the $Y_{56}Al_{24}Co_{20}$ amorphous phase may be present in a range from 45.0 at % to 55.0 at %.

A plurality of pores formed in the porous metallic glass may be formed by removing Y elements from the $Y_{56}Al_{24}Co_{20}$ amorphous phase. Pores formed in the porous metallic glass may have sizes in a range from 10 nm to 500 nm.

According to another aspect of the present invention, a method for manufacturing the above porous metallic glass includes melting the porous metallic glass comprising Ti, Y, Al, Co, and the impurities, forming an amorphous phase by rapidly solidifying the porous metallic glass, and forming a porous network structure in the porous metallic glass by de-alloying the porous metallic glass using an electrochemical method.

In the forming of an amorphous phase, two or more amorphous phases may be formed in the porous metallic glass, and the two or more amorphous phases may include a $Ti_{56}Al_{24}Co_{20}$ amorphous phase and a $Y_{56}Al_{24}Co_{20}$ amorphous phase. The $Ti_{56}Al_{24}Co_{20}$ amorphous phase may be present in a range from 50.0 at % to 80.0 at %, and the $Y_{56}Al_{24}Co_{20}$ amorphous phase may be present in a range from 20.0 at % to 50.0 at %. In the forming of a porous network structure, Y elements may be removed from the $Y_{56}Al_{24}Co_{20}$ amorphous phase by de-alloying.

According to another aspect of the present invention, a method for manufacturing the above porous metallic glass includes melting the porous metallic glass comprising Zr, Y, Al, Co, and the impurities, forming an amorphous phase by rapidly solidifying the porous metallic glass, and forming a porous network structure in the porous metallic glass by de-alloying the porous metallic glass using an electrochemical method.

In the forming of an amorphous phase, two or more amorphous phases may be formed in the porous metallic glass, and the first amorphous phase of the two or more amorphous phases may be a $Zr_{55}Al_{20}Co_{25}$ amorphous phase while the second amorphous phase may be a $Y_{56}Al_{24}Co_{20}$ amorphous phase. The $Zr_{55}Al_{20}Co_{25}$ amorphous phase may be present in a range from 45.0 at % to 55.0 at %, and the $Y_{56}Al_{24}Co_{20}$ amorphous phase may be present in a range from 45.0 at % to 55.0 at %. In the forming of a porous network structure, Y elements may be de-alloyed from the $Y_{56}Al_{24}Co_{20}$ amorphous phase by using an electrochemical method.

DETAILED DESCRIPTION OF THE EMBODIMENTS

Figure 1:
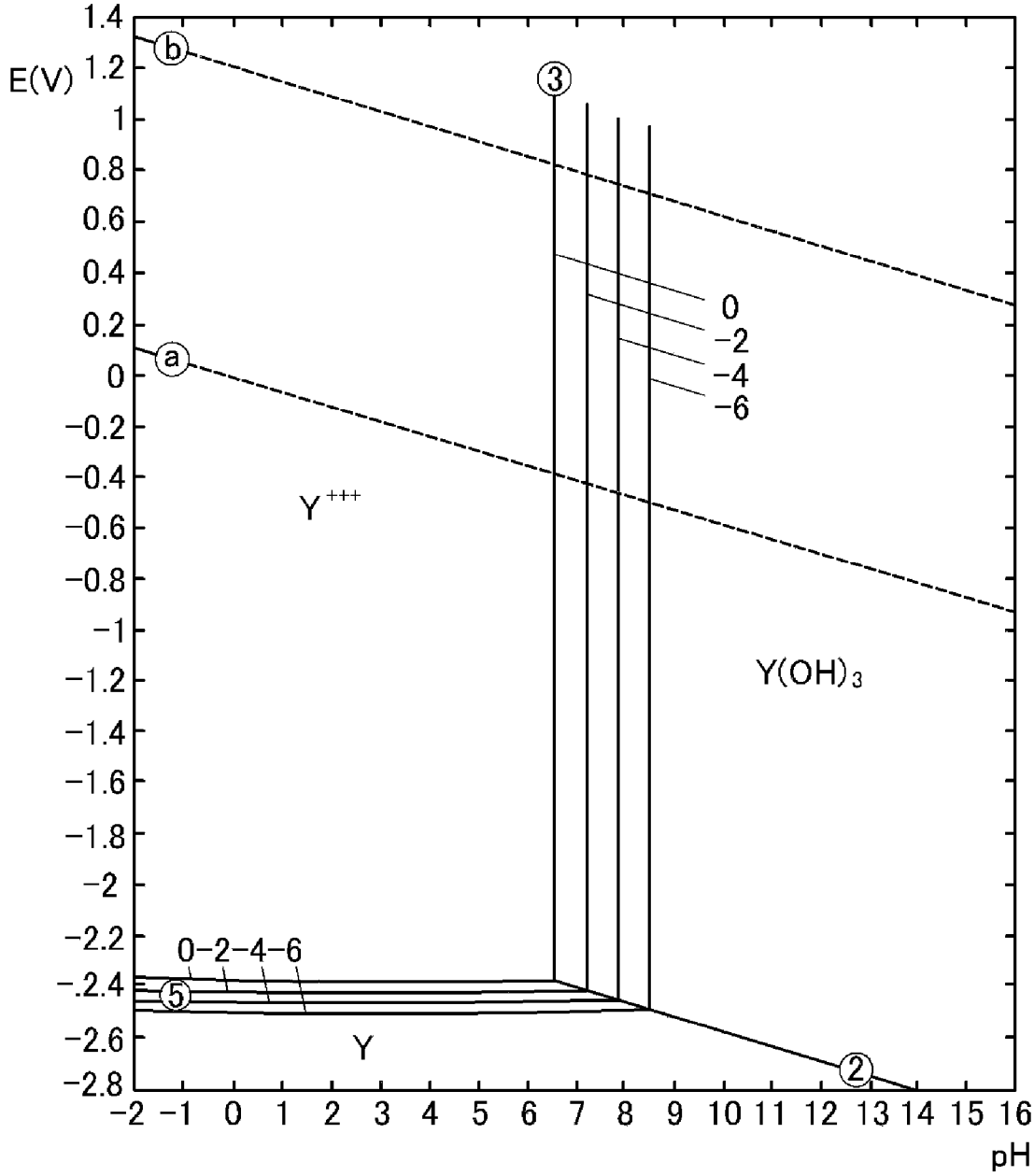
FIG. 1 is a potential-pH (Pourbaix) diagram of the Y element.

Hereinafter, exemplary embodiments of the present invention will be described in detail with reference to FIGS. 1 to 5. However, the present invention is not limited to the exemplary embodiments, but may be embodied in various forms.

A method for manufacturing porous metallic glass is summarized as follows. First, metallic glass is manufactured by a rapid solidification technique. Next, a plurality of pores are formed in the metallic glass by de-alloying the metallic glass by using an electrochemical method and removing a specific element from the metallic glass. By means of the aforementioned process, the porous metallic glass can be manufactured.

Porous metallic glass is manufactured by using solid state immiscibility and different electrochemical properties between elements. Elements that are immiscible in a solid state are chosen for manufacture of the metallic glass, and alloys mainly including immiscible elements are separated from each other in the metallic glass. If electrochemical properties of the immiscible elements are different, a specific element can be removed by the de-alloying technique. By removing a specific element, a plurality of pores are formed in the metallic glass such that the porous metallic glass can be manufactured.

Element groups that meet the aforementioned conditions include titanium (Ti) and yttrium (Y), as well as zirconium (Zr) and Y. Porous metallic glass can be manufactured by adding aluminum (Al) and cobalt (Co) that assist in metallic glass formation to alloys including the above elements. In the embodiment of the present invention, porous metallic glass is manufactured by using Ti-based or Zr-based metals.

First, a Ti—Y—Al—Co alloy is described as follows. After forming amorphous phases and de-alloying, the Ti—Y—Al—Co alloy contains Ti at 50.0 at % to 70.0 at %, Y at 0.5 at % to 10.0 at %, Al at 10.0 at % to 30.0 at %, Co at 10.0 at % to 30.0 at %, and impurities. The sum of Ti, Y, Al, Co, and the impurities is 100.0 at %.

If atomic percentages of the Ti and the Y are not in the aforementioned ranges, proportions of Ti-based and Y-based amorphous phases become different. In this case, an amorphous composition with an appropriate structure cannot be obtained. Y is prepared by an electrolysis method in order to manufacture the porous metallic glass, and it is essentially contained therein. If atomic percentages of the Al and the Co are not in the aforementioned range, amorphous formation is difficult.

Ti and Y are immiscible in a solid state, and they are chosen based on the immiscibility. In addition, since the Ti and the Y have different electrochemical properties, they can be removed from metallic glass by de-alloying. By means of the aforementioned process, the porous metallic glass can be manufactured.

A Zr—Y—Al—Co alloy is described as follows. After forming the amorphous phase and de-alloying, the Zr—Y—Al—Co alloy contains Zr at 50.0 at % to 70.0 at %, Y at 0.5 at % to 10.0 at %, Al at 10.0 at % to 30.0 at %, Co at 10.0 at % to 30.0 at %, and impurities. The sum of Zr, Y, Al, Co, and the impurities is 100.0 at %.

If atomic percentages of the Zr and the Y are not in the aforementioned ranges, proportions of Zr-based and Y-based amorphous phases become different. In this case, an amorphous composition with an appropriate structure cannot be obtained. Y is prepared by an electrolysis method in order to manufacture the porous metallic glass, and is essentially contained therein. If atomic percentages of the Al and the Co are not in the aforementioned range, amorphous formation is difficult.

Zr and Y are immiscible in a solid state, and they are chosen based on the immiscibility. In addition, since the Zr and the Y have different electrochemical properties, Y can only be removed from the metallic glass by de-alloying. By using the aforementioned process, the porous metallic glass can be manufactured.

For forming the metallic glass, Ti-based or Zr-based alloys are super-cooled to below the solidification temperature. For the Ti-based and Zr-based alloys, the solidification temperature is about 450° C. The liquid is rapidly cooled from a molten state and is solidified. Unlike normal metals, the liquid of the metallic glass does not form crystals while being changed into the solid. This non-crystalline solid structure makes the metallic glass much stronger than ceramics by a factor of 2 to 3.

Nanometer-sized porous Ti-based and Zr-based metallic glass is manufactured by applying the de-alloying technique to Ti—Y—Al—Co and Zr—Y—Al—Co alloys with a two-phase amorphous structure. These alloys are chosen based firstly on their electrical properties, secondly on their glass forming ability, and thirdly on their immiscibility with Y.

By removal of the Y element in the Y—Al—Co phase, a porous network structure with a pore size in a range from 10 nm to 500 nm is formed depending on the initial microstructure, applied potential, and time. The size of the pores is mainly determined by an ideal amorphous structure. If a potential in an appropriate range is applied, a controlled pore size in the range 10 nm to 500 nm can be obtained. In the formation of the amorphous phase, more of the fine amorphous phase can be obtained with a faster cooling speed. Therefore, by changing the cooling speed, the pore size is determined by controlling the initial structure.

Meanwhile, if the applied potential is not in the aforementioned range, the controlled pore size as described above is difficult to obtain. Using the applied potential, namely, an electric potential, the porous metallic glass manufacturing speed can be controlled. If the applied potential increases, time for manufacturing the porous metallic glass decreases. On the other hand, if the applied potential decreases, time for manufacturing the porous metallic glass increases.

Metallic glass with a pore size in the range from 10 nm to 500 nm can be manufactured based on the principle of de-alloying which is a simple, quick, and inexpensive method that is applied to two-phase amorphous materials. In addition to a controlled pore size, this method can result in the formation of pores with various architectures, which can provide remarkable properties.

The de-alloying technique involves extracting one or more elements constituting an alloy. Alloys including two or more elements show different electrochemical properties, i.e., a few elements are rarer than others. By removing more reactive elements, a nanoscale network can be formed. This operation can be achieved by immersion in an appropriately selected chemical solution or by an electrochemical method.

The electrochemical method can be more quickly carried out and can provide better control of the pore formation than the chemical solution method. In this case, if the alloy is used as an electrode in an electrochemical cell and a voltage in a specific range is applied, the less-rare elements are dissolved. The choice of the electrochemical solution is important since it dictates the window at which the selective dissolution occurs. For easy control, a wide window is preferable since a large difference existing between the potentials at which elements form ions would allows one element to be dissolved in the electrolyte while the others would remain. As a consequence of the constant removal of the less inert element(s), the final structure results in a porous network structure with a pore size ranging from 10 nm to 500 nm and a surface area of about 20 $m^2/g$. If the pore size is less than 10 nm, an effect owing to the porosity is difficult to expect. If the pore size is larger than 500 nm, quality of the materials deteriorates.

For de-alloying to take place, two conditions should be met in addition to a difference of electrochemical properties. One is a critical potential Ec, and the other is the parting limit. De-alloying occurs for a minimum applied critical potential Ec. Beyond the Ec value, de-alloying rapidly occurs, while below the Ec value, de-alloying can be very slow. The value of Ec also depends on the concentration of the less inert element and on the nature of an oxide layer formed on the surface.

De-alloying occurs if the concentration of the less inert element exceeds a specific concentration. The concentration of the rare element in a case where the critical potential Ec is substantially the same as an oxidation-reduction potential of an oxide is named as the parting limit of a specific oxide. In this case, de-alloying does not occur. It is difficult to manufacture the porous metallic glass since the amorphous phase usually forms in a narrow range of composition that is far from equi-concentration.

In the embodiment of the present invention, metallic glass such as Ti—Y—Al—Co and Zr—Y—Al—Co including two amorphous phases are used. In these alloys, Y is miscible with neither Ti nor Zr. However, Ti—Al—Co, Zr—Al—Co, and Y—Al—Co can form amorphous phases. Thus, the preparation of alloys with a composition near $(Ti—Al—Co)_{\alpha}(Y—Al—Co)_{(1-\alpha)}$ and $(Zr—Al—Co)_{\beta}(Y—Al—Co)_{(1-\beta)}$ results in the formation of metallic glass with two separate amorphous phases with interconnected structure for $0.50 \leqq \alpha \leqq 0.80$ and $0.45 \leqq \beta \leqq 0.55$. Here, $\alpha$ and $\beta$ denote atomic percentages. Application of the de-alloying technique to those alloys essentially induces the removal of Y elements from the Y—Al—Co amorphous phase and results in the formation of a porous network structure in a Ti-based and a Zr-based metallic glass.

Electrochemical Properties

Figure 2:
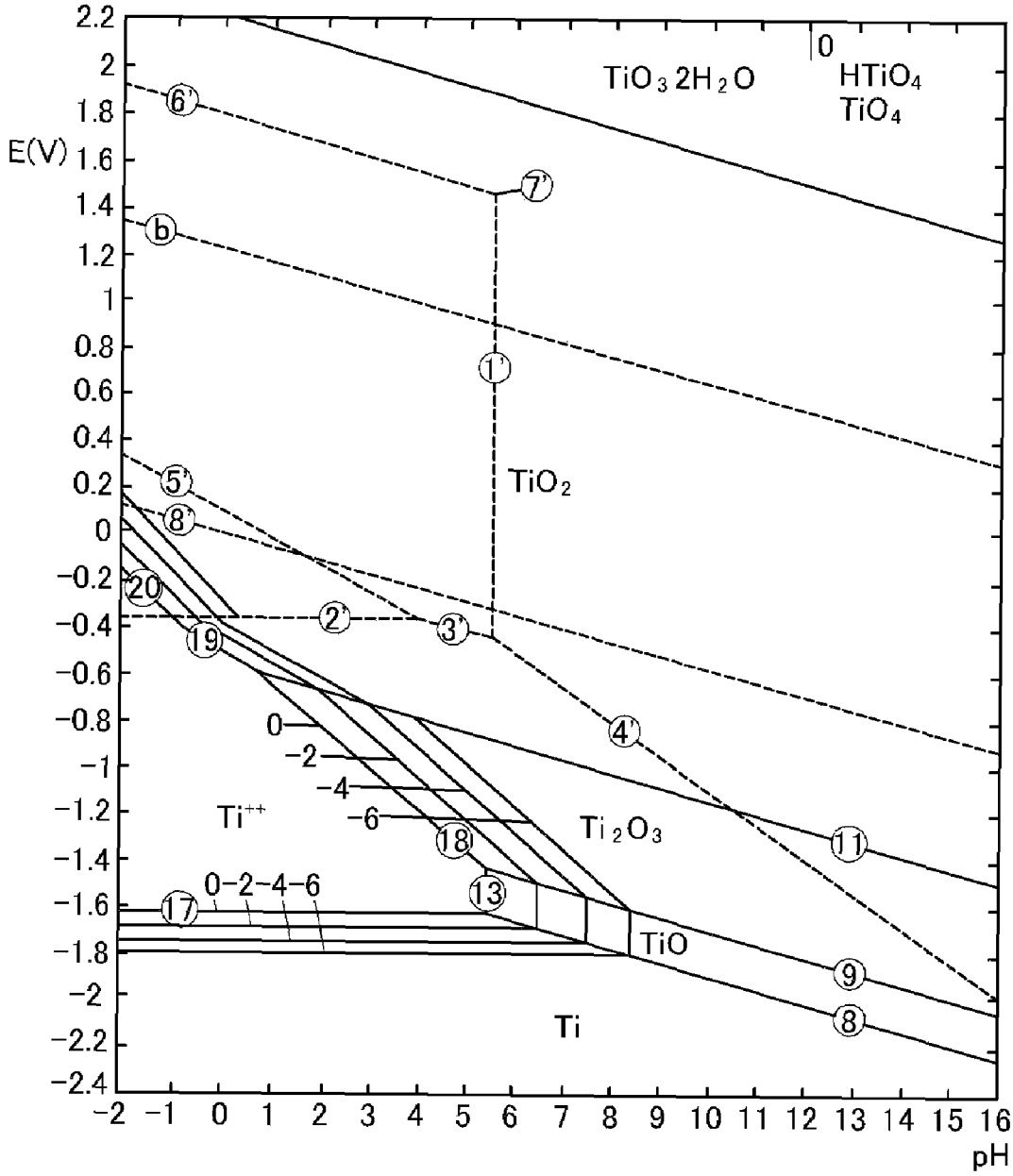
FIG. 2 is a potential-pH (Pourbaix) diagram of the T element.
Figure 3:
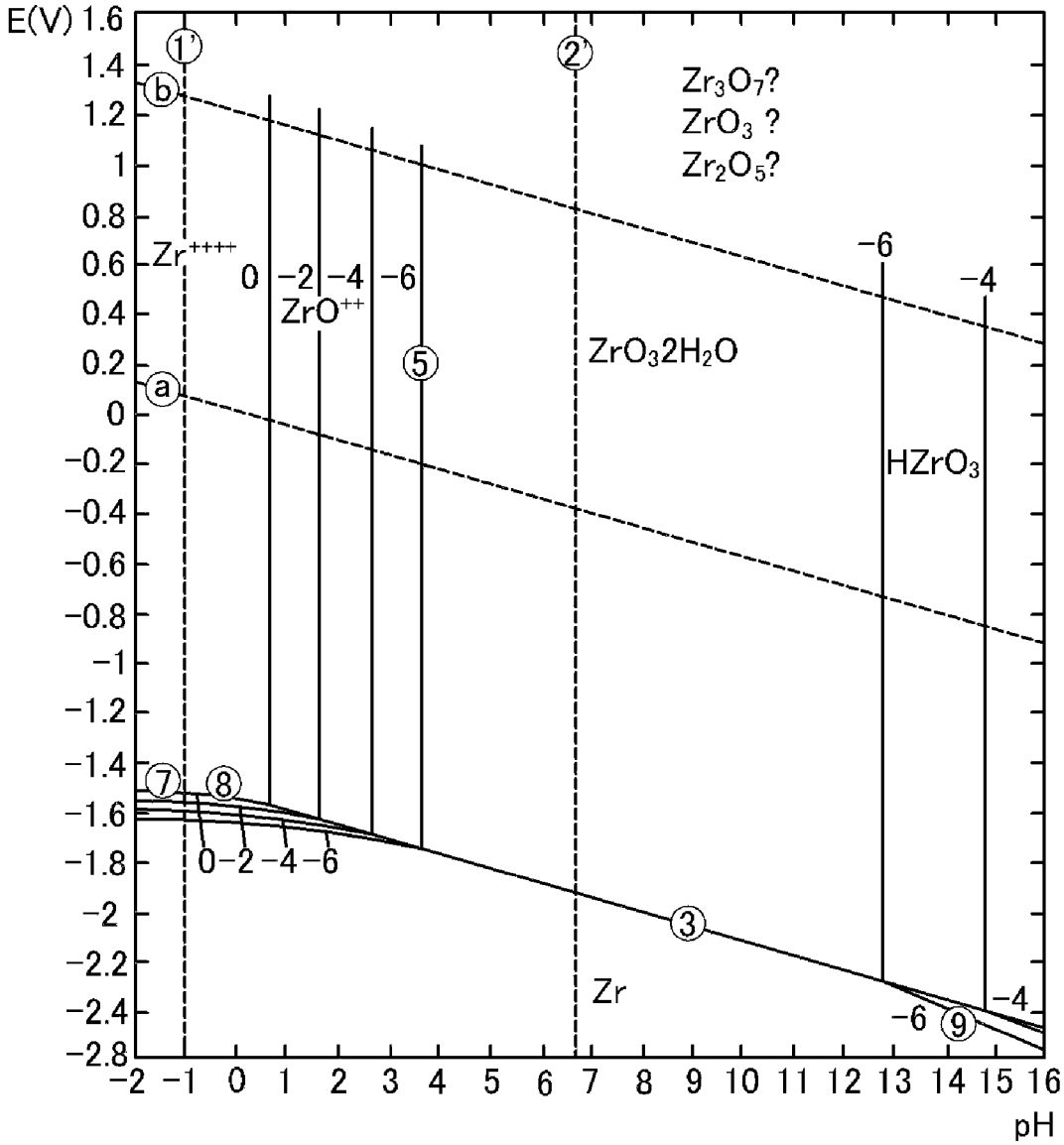
FIG. 3 is a potential-pH (Pourbaix) diagram of the Zr element.

FIGS. 1 to 3 are Pourbaix diagrams for Y, Ti, and Zr elements that show distinct electrochemical behavior of these elements, respectively.

As illustrated in FIG. 1, Y has a great affinity to react with an aqueous solution of any pH value. In particular, in the presence of an acidic and neutral solution (pH=0 to 7), this metal is unstable and becomes yttric (Y+++) ions.

As illustrated in FIG. 2, Ti can form oxides such as TiO, $TiO_2$, and $Ti_2O_3$ in the aqueous solution, and can be protected from corrosion. Therefore, if Y and Ti are elements contained in an alloy, the selective dissolution of Y can be easily achieved by suitably controlling the pH of the acidic solution.

As illustrated in FIG. 3, the Zr can form oxides such as ZrO and $ZrO_2$ in the aqueous solution, and is protected from corrosion. Therefore, if Y and Zr are elements contained in an alloy, the selective dissolution of Y could be easily achieved by suitably controlling the pH of the acidic solution.

Solid State Immiscibility

In the embodiment of the present invention, elements are chosen based on their immiscibility. Depending on the electron density at the boundary of the Wigner-Seitz atomic cell and electro-negativity, elements form either an intermetallic compound or a solid solution. However, metals with very different electronic properties such as electron density taken at a common value of the cell-boundary density are immiscible because of a discontinuity of the electron density.

Figure 4:
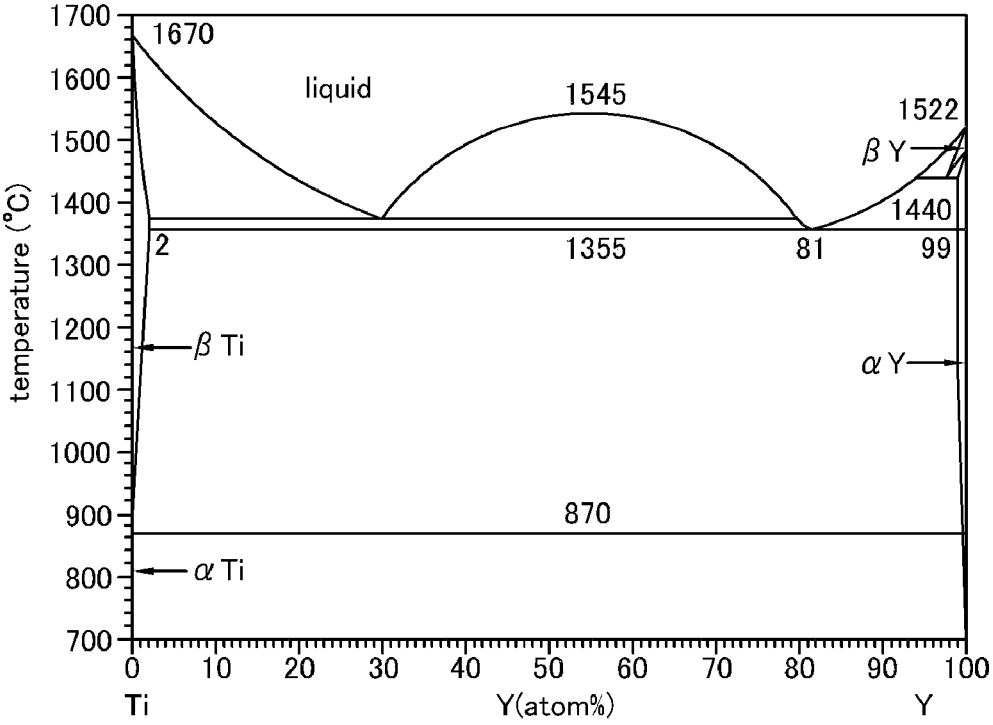
FIG. 4 is a Ti—Y binary phase diagram.
Figure 5:
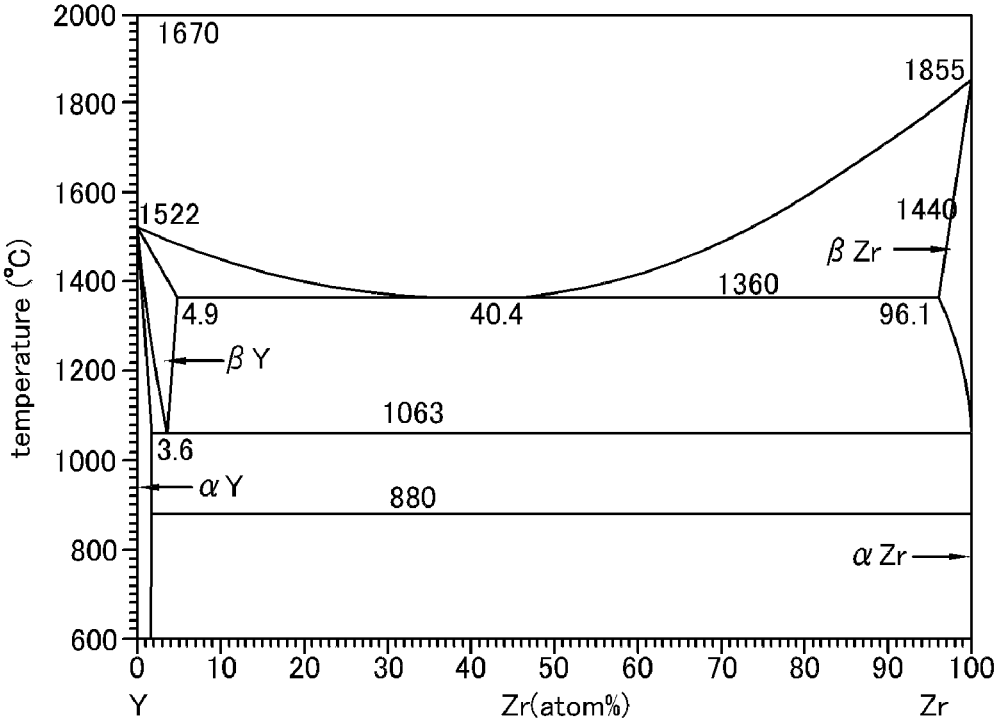
FIG. 5 is a Zr—Y binary phase diagram.

This is demonstrated well in binary phase diagrams of Ti—Y and Zr—Y alloys shown in FIGS. 4 and 5. As illustrated in FIG. 4, the Ti—Y alloy does not form compounds or solid solutions but forms a two-phase microstructure at a temperature below 1355° C. The Ti forms only an $\alpha$Ti phase or only a $\beta$Ti phase, and the Y forms only an $\alpha$Y phase, so the Ti—Y alloy forms separated phases in a solid state. Therefore, separated phases can be obtained from the Ti—Y—Al—Co alloy. These phases are separated to be shown as a Ti—Al—Co alloy and a Y—Al—Co alloy.

Meanwhile, as illustrated in FIG. 5, the Zr—Y alloy does not form compounds or solid solution but forms two-phase microstructures at a temperature below 1063° C. The Zr forms only an αZr phase, and the Y forms only an αY phase or only a βY phase. Therefore, the Zr—Y alloy forms separated phases in a solid state. Accordingly, separated phases can be obtained from the Zr—Y—Al—Co alloy. These phases are separated to be shown as a Zr—Al—Co alloy and a Y—Al—Co alloy.

Hereinafter, experimental examples of the present invention will be described in detail. However, the present invention is not limited to the experimental examples, but may be varied in other forms.

Amorphous Structure

First, Ti—Y—Al—Co alloy was manufactured by a method as follows. A molten metal containing Ti, Al, Co, and Y was cooled at a speed faster than $10^5$ K/sec and formed amorphous phases of a Ti—Al—Co alloy and a Y—Al—Co alloy. For example, Ti-based and Y-based glassy alloys were thus prepared by a melt-spinning technique in the form of thin ribbons of about 3 mm thick, 7 mm wide, and several meters long.

On the other hand, a Zr—Y—Al—Co alloy was manufactured by a method as follows. A molten metal containing Zr, Al, Co, and Y was cooled at a speed faster than $10^2$ K/sec and formed amorphous phases of a Zr—Al—Co alloy and a Y—Al—Co alloy. The size of a ribbon was formed to be the same as that of the aforementioned Ti-based alloy.

Figure 6:
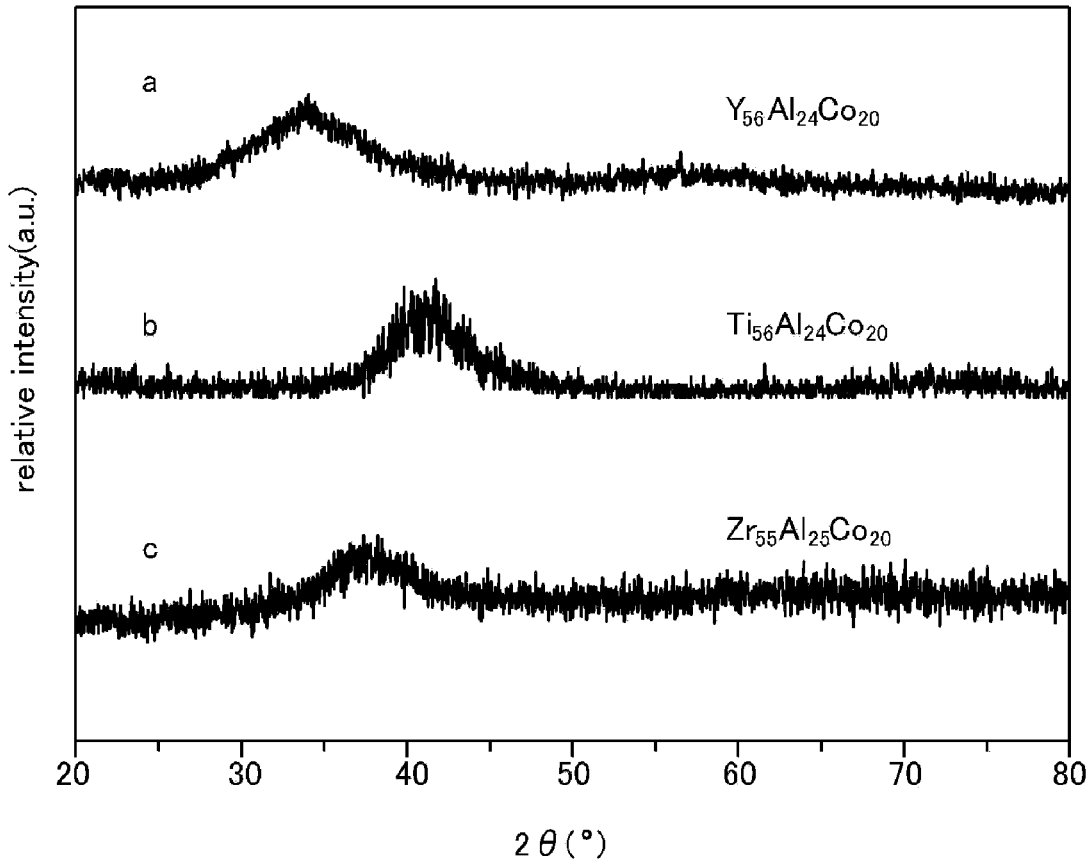
FIG. 6 is a graph showing x-ray diffraction examination (XRD) traces obtained for a. $Y_{56}Al_{24}Co_{20}$, b. $Ti_{56}Al_{24}Co_{20}$, and c. $Zr_{55}Al_{20}Co_{25}$ ribbons.

The halo peaks of XRD traces obtained for $Y_{56}Al_{24}Co_{20}$, $Ti_{56}Al_{24}Co_{20}$, and $Zr_{55}Al_{20}Co_{25}$ alloy ribbons are shown in the left side of a to c in FIG. 6, respectively. The halo peaks confirm the existence of amorphous phases in these alloys after rapid solidification.

Two Phase Amorphous Structure

As described above, Ti and Y are not miscible in a solid state. Therefore, if an amorphous phase is formed from a molten metal containing Ti, Al, Y, and Co, two-phase amorphous phases separated into Ti—Al—Co and Y—Al—Co are formed.

In addition, Zr and Y are not miscible in a solid state. Therefore, if an amorphous phase is formed from a molten metal containing Zr, Al, Y, and Co, two-phase amorphous phases separated into Zr—Al—Co and Y—Al—Co are formed. This will be described with reference to FIGS. 7 and 8.

Figure 7:
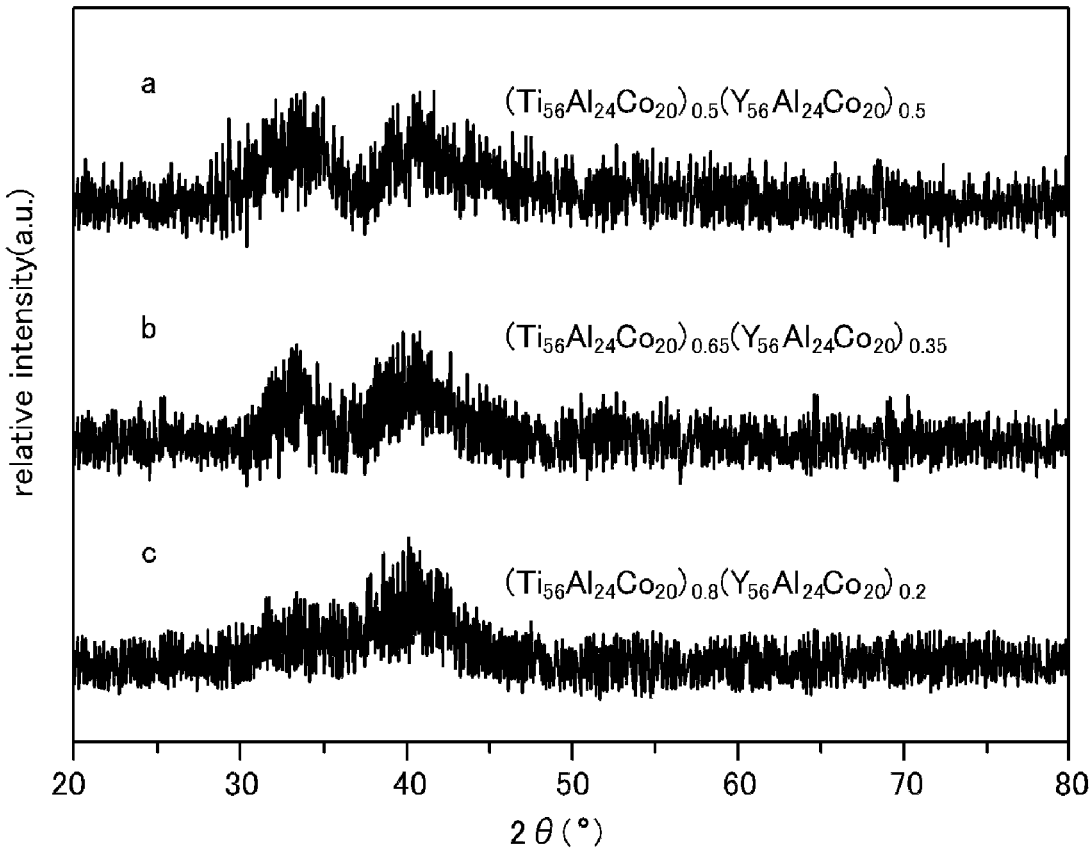
FIG. 7 is a graph showing XRD traces obtained for $(Ti_{56}Al_{24}Co_{20})a(Y_{56}Al_{24}Co_{20})_{(1-\alpha)}$ ribbons, where (a) $\alpha$=0.5, (b) $\alpha$=0.65, and (c) $\alpha$=0.80.

FIG. 7 is a graph showing XRD traces obtained for $(Ti_{56}Al_{24}Co_{20})_\alpha(Y_{56}Al_{24}Co_{20})_{(1-\alpha)}$ ribbons, where (a) α=0.5, (b) α=0.65, and (c) α=0.80. In the experimental example of the present invention, alloys with a two-phase amorphous structure were prepared for the composition $(Ti_{56}Al_{24}Co_{20})_\alpha(Y_{56}Al_{24}Co_{20})_{(1-\alpha)}$ with α=0.5, 0.65, and 0.8.

As illustrated in FIG. 7, $(Ti_{56}Al_{24}Co_{20})_\alpha(Y_{56}Al_{24}Co_{20})_{(1-\alpha)}$ alloy has two broad peaks with diffraction angles (2θ) of about 33° and 40°. The XRD graph shows that two amorphous phases exist in the $(Ti_{56}Al_{24}Co_{20})_\alpha(Y_{56}Al_{24}Co_{20})_{(1-\alpha)}$ alloy for α=0.5, 0.65, and 0.8, respectively. Due to atomic radius differences, Ti-based and Y-based amorphous phases are characterized by two broad peaks.

Figure 8:
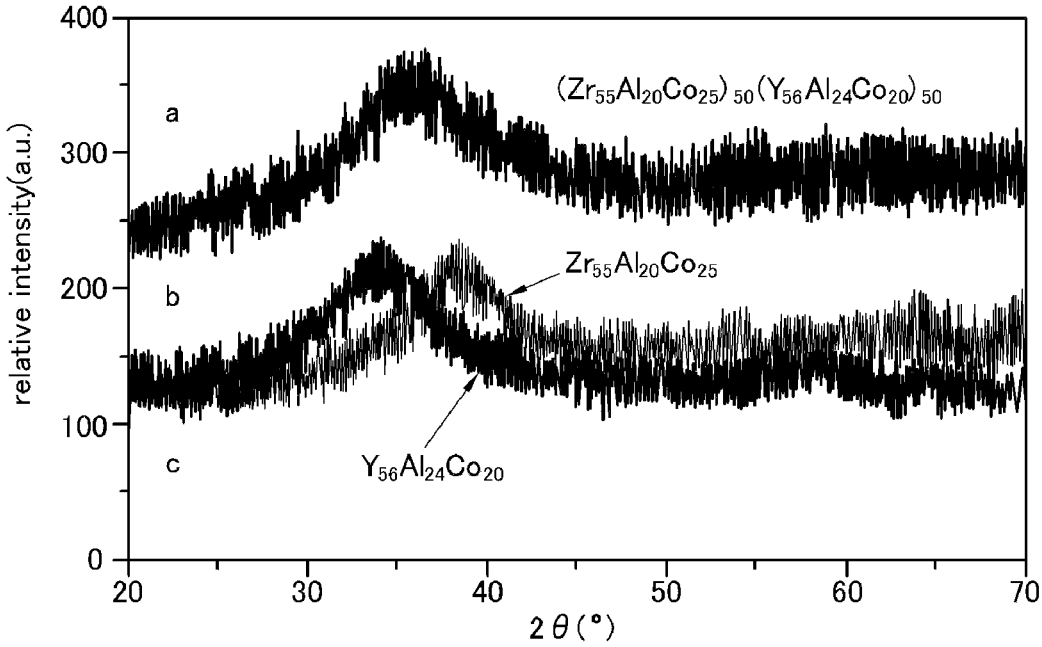
FIG. 8 is a graph showing XRD traces obtained for (a) $(Zr_{55}Al_{20}Co_{25})_{50}(Y_{56}Al_{24}Co_{20})_{50}$, (b) $Zr_{55}Al_{20}Co_{25}$, and (c) $Y_{56}Al_{24}Co_{20}$ ribbons.

The a of FIG. 8 illustrates the XRD traces obtained for $(Zr_{55}Al_{20}Co_{25})_{50}(Y_{56}Al_{24}Co_{20})_{50}$, the b of FIG. 8 illustrates the XRD traces obtained for $Zr_{55}Al_{20}Co_{25}$, and the c of FIG. 8 illustrates the XRD traces obtained for $Y_{56}Al_{24}Co_{20}$ ribbons. The XRD trace obtained for the $(Zr_{55}Al_{20}Co_{25})_{50}(Y_{56}Al_{24}Co_{20})_{50}$ ribbon corresponds to an alloy with the composition $(Zr_{55}Al_{20}Co_{25})_\beta(Y_{56}Al_{24}Co_{20})_{(1-\beta)}$ with β=0.5. The $Y_{56}Al_{24}Co_{20}$ ribbon is characterized by a peak shifted to the left from 35.5°, and the $Zr_{55}Al_{20}Co_{25}$ ribbon is characterized by a peak shifted to the right from 35.5°.

The $(Zr_{55}Al_{20}Co_{25})_{50}(Y_{56}Al_{24}Co_{20})_{50}$ ribbon formed by overlapping the $Y_{56}Al_{24}Co_{20}$ amorphous phase with the $Zr_{55}Al_{20}Co_{25}$ amorphous phase is characterized by a peak for 35.5°. The peak shows the overlapped $Zr_{55}Al_{20}Co_{25}$ and $Y_{56}Al_{24}Co_{20}$ amorphous phases. That is, since an atomic radius of the Zr-based amorphous phase is similar to that of the Y-based amorphous phase, the peaks are overlapped and the peaks are shown as a single peak. Therefore, as shown as a of FIG. 8, the $(Zr_{55}Al_{20}Co_{25})_{50}(Y_{56}Al_{24}Co_{20})_{50}$ ribbon has the amorphous phase.

Figure 9:
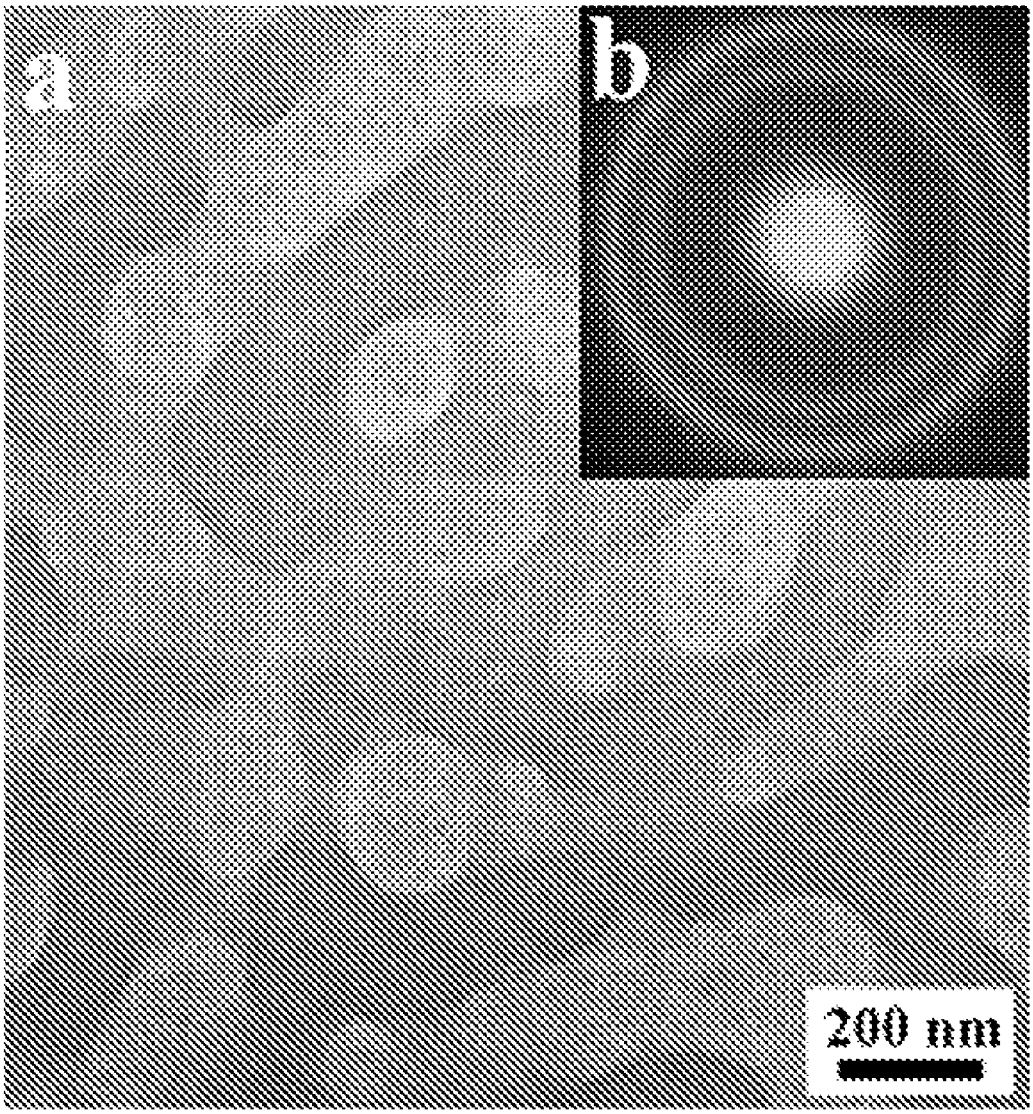
FIG. 9 shows (a) a TEM bright field image, and (b) a selected area electron diffraction pattern (SAEDP) of a $(Ti_{56}Al_{24}Co_{20})_{0.65}(Y_{56}Al_{24}Co_{20})_{0.35}$ alloy.

FIG. 9 shows (a) TEM bright field image, and (b) a corresponding selected area electron diffraction pattern (SAEDP) of a $(Ti_{56}Al_{24}Co_{20})_{0.65}(Y_{56}Al_{24}Co_{20})_{0.35}$ alloy. The alloy corresponds to the alloy shown as the b of FIG. 7, and a ratio of the $(Ti_{56}Al_{24}Co_{20})_\alpha$ is 65% while a ratio of the $(Y_{56}Al_{24}Co_{20})$ 35%.

As illustrated as a of FIG. 9, a $Ti_{56}Al_{24}Co_{20}$ amorphous phase and a $Y_{56}Al_{24}Co_{20}$ amorphous phase exist. Here, the $Ti_{56}Al_{24}Co_{20}$ amorphous phase is shown as black portions while the $Y_{56}Al_{24}Co_{20}$ amorphous phase is shown as gray portions. The phases are interconnected.

However, if the content of the $Ti_{56}Al_{24}Co_{20}$ is beyond 80% or below 50%, the microstructure is changed. That is, it results in a heterogeneous structure including isolated Y-rich spheres in a Ti-rich matrix or isolated Ti-rich spheres in a Y-rich matrix.

Figure 10:
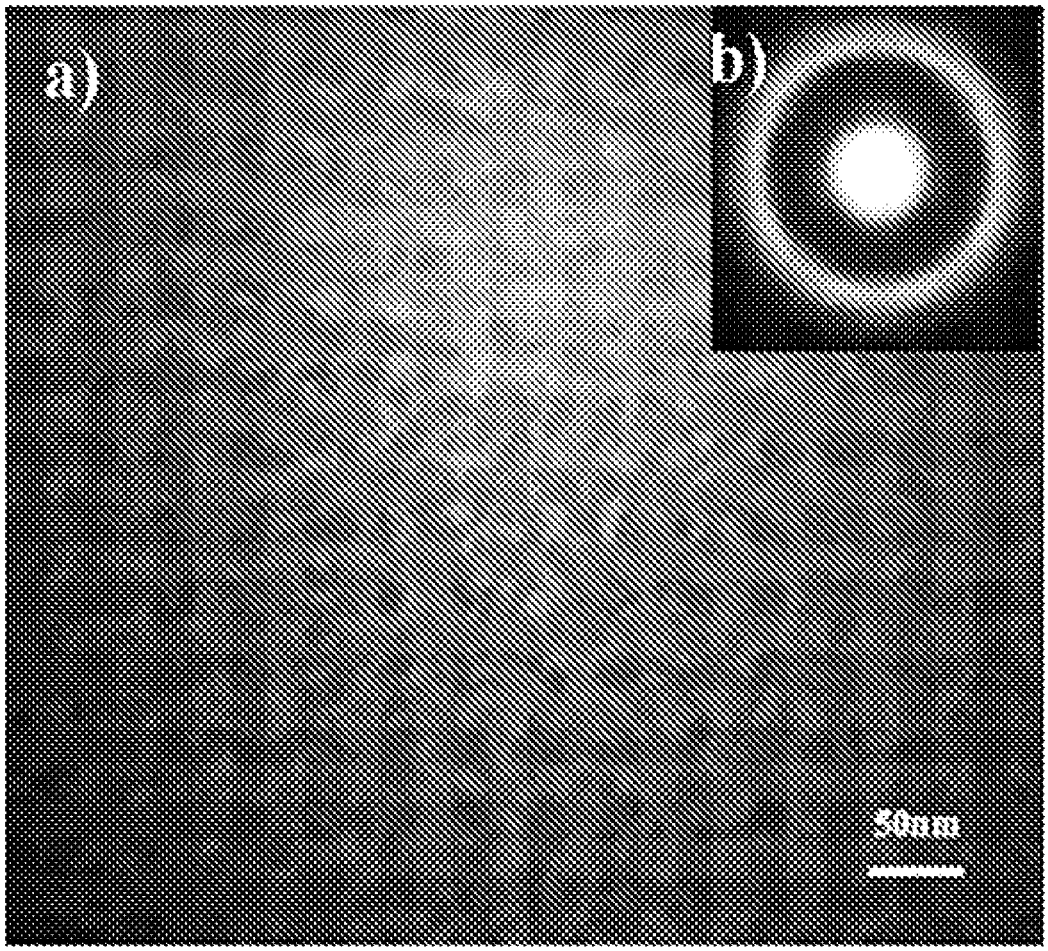
FIG. 10 shows (a) a TEM bright field image, and (b) an SAEDP of a $(Zr_{55}Al_{20}Co_{25})_{0.5}(Y_{56}Al_{24}Co_{20})_{0.5}$ alloy.

FIG. 10 shows (a) TEM bright field image, and (b) corresponding SAEDP of the $(Zr_{55}Al_{20}Co_{25})_{0.5}(Y_{56}Al_{24}Co_{20})_{0.5}$ alloy. The alloy corresponds to the alloy shown as a of FIG. 8.

Here, the $Zr_{55}Al_{20}Co_{25}$ amorphous phase is shown as black portions, and the $Y_{56}Al_{24}Co_{20}$ amorphous phase is shown as gray portions. The phases are interconnected. As illustrated in FIG. 10, two amorphous phases are separated from each other and a very fine interconnected structure was formed therebetween.

A plurality of pores were formed in the two amorphous phases formed by the aforementioned method by using a de-alloying technique. Hereinafter, the de-alloying technique will be described in detail.

De-Alloying

In the experimental example of the present invention, a specific element was removed from amorphous phases by using a de-alloying technique. In particular, the de-alloying technique for forming a plurality of pores is suitable for an alloy with two interconnected amorphous phases.

Potentio-dynamical tests were performed in an electrochemical cell with a 0.1M $HNO_3$ (pH=1) electrolyte using the $(Ti_{56}Al_{24}Co_{20})_{0.65}(Y_{56}Al_{24}Co_{20})_{0.35}$ ribbon specimen or the $(Zr_{55}Al_{20}Co_{25})_{0.5}(Y_{56}Al_{24}Co_{20})_{0.5}$ bulk specimen as an active electrode substituting for platinum and Ag/AgCl reference electrodes, respectively.

Figure 11:
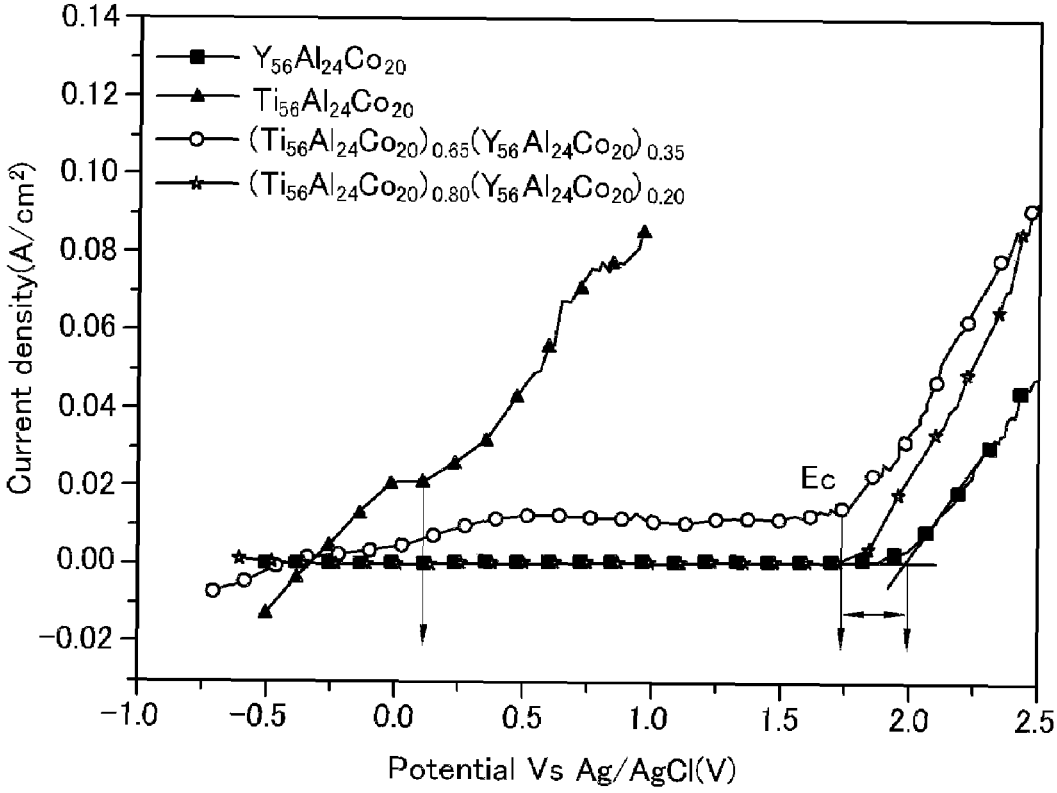
FIG. 11 shows potentio-dynamic curves of $Ti_{56}Al_{24}Co_{20}$, $Y_{56}Al_{24}Co_{20}$, $(Ti_{56}Al_{24}Co_{20})_{0.65}(Y_{56}Al_{24}Co_{20})_{0.35}$, and $(Ti_{56}Al_{24}Co_{20})_{0.8}(Y_{56}Al_{24}Co_{20})_{0.20}$ ribbons in 0.1 M $HNO_3$ solution.

As illustrated in FIG. 11, Y—Al—Co and Ti—Al—Co amorphous alloys have distinct electrochemical behaviors. The Ti—Al—Co alloy is characterized by a wide passivation characteristic to almost 2.0V while the Y—Al—Co alloy shows little sign of passivation. This means that the Y—Al—Co alloy is corroded under a voltage in which the Ti—Al—Co alloy is corroded. This difference in the electrochemical behavior is suitable for de-alloying.

In addition, the electrochemical behavior of the two-phase amorphous $(Ti_{56}Al_{24}Co_{20})_{0.65}(Y_{56}Al_{24}Co_{20})_{0.35}$ alloy and $(Ti_{56}Al_{24}Co_{20})_{0.80}(Y_{56}Al_{24}Co_{20})_{0.20}$ alloy is shown in FIG. 11. The critical potentials Ec of these alloys are found between those of the Y—Al—Co alloy and the Ti—Al—Co alloy, near 1.75V.

Figure 12:
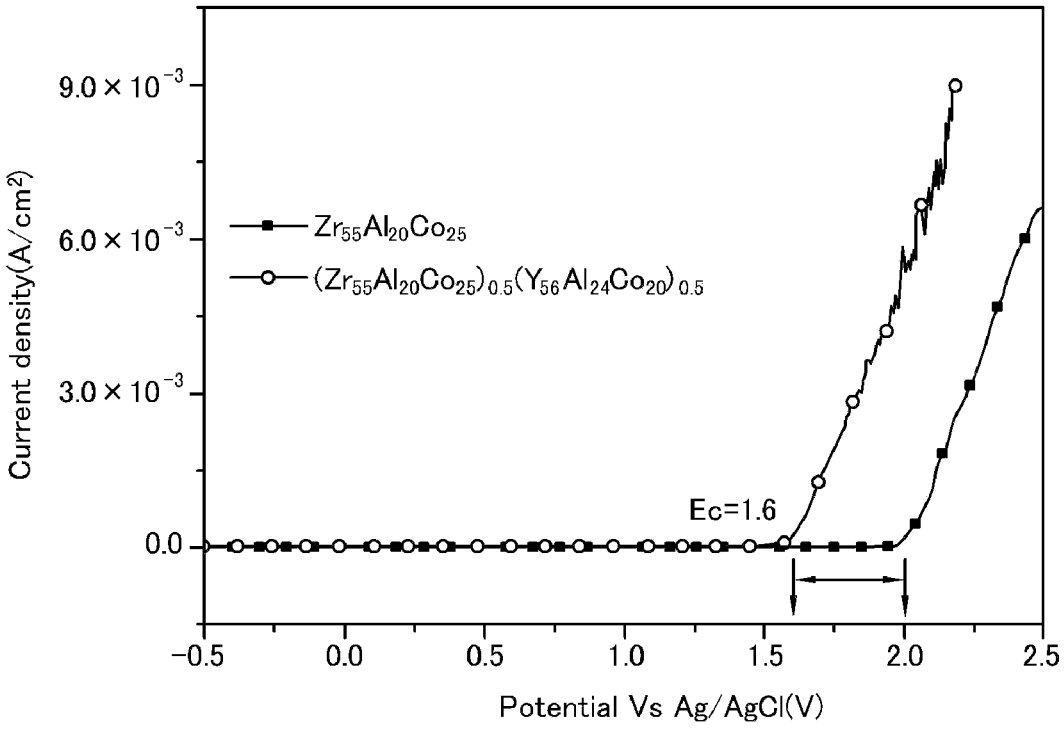
FIG. 12 shows potentio-dynamic curves of $Zr_{55}Al_{20}Co_{25}$ and $(Zr_{55}Al_{20}Co_{25})_{0.5}(Y_{56}Al_{24}Co_{20})_{0.5}$ ribbons in 0.1 M $HNO_3$ solution.

FIG. 12 shows potentio-dynamic curves of Zr-based alloys such as a $Zr_{55}Al_{20}Co_{25}$ alloy and a $(Zr_{55}Al_{20}Co_{25})_{0.5}$ $(Y_{56}Al_{24}Co_{20})_{0.5}$ alloy. Potentio-dynamic curves of Y-based glassy alloys are omitted for convenience in FIG. 12.

As illustrated in FIG. 12, since the $(Zr_{55}Al_{20}Co_{25})_{0.5}(Y_{56}Al_{24}Co_{20})_{0.5}$ alloy has a critical potential Ec of about 1.6V, the de-alloying technique can be applied. The applied potential was selected between 1.7 and 2.0V and then de-alloying was achieved in a short time.

Figure 13A:
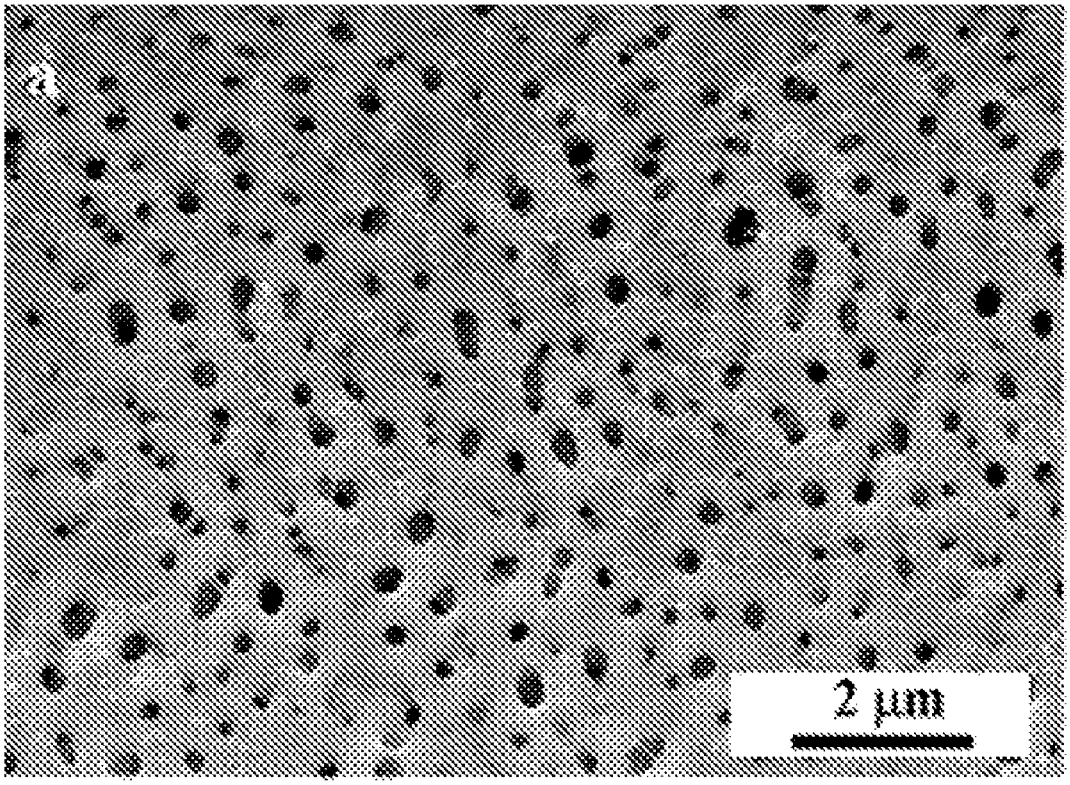
FIG. 13A is a scanning electron microscopy (SEM) image of a surface of a ribbon after de-alloying under a potential of 1.9V for 30 minutes.
Figure 13B:
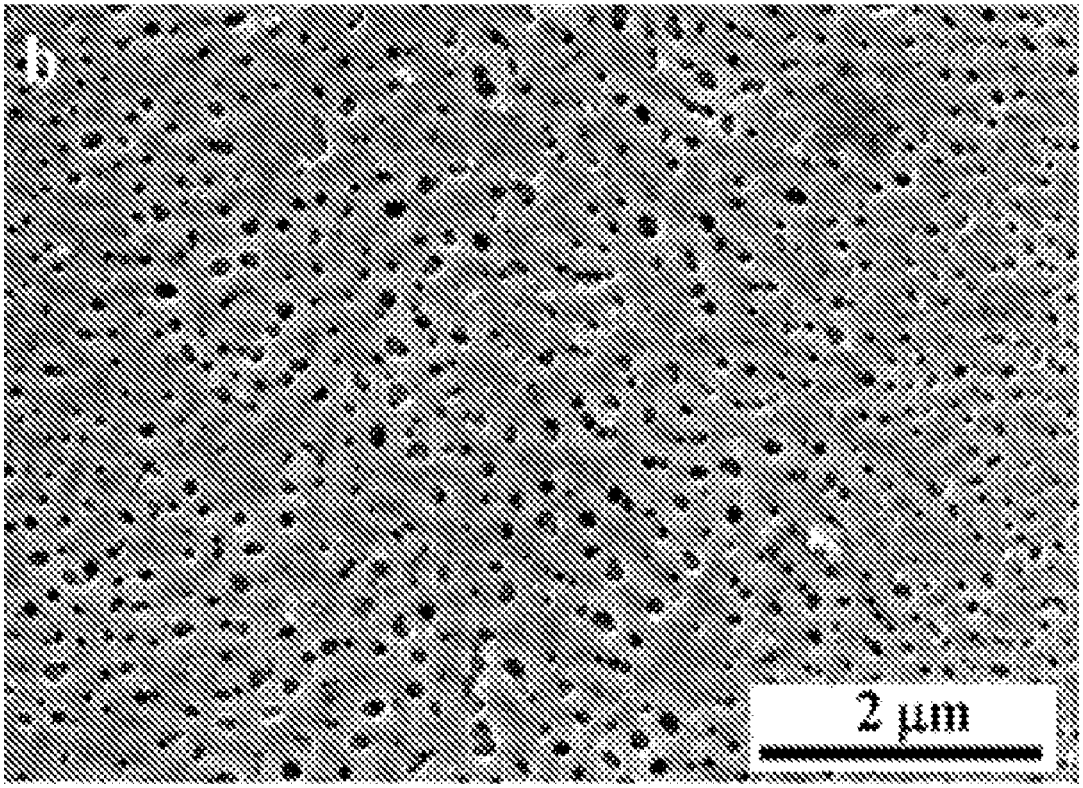
FIG. 13B is a SEM image of a surface of a ribbon after de-alloying by immersion for 24 hours.
Figure 13C:
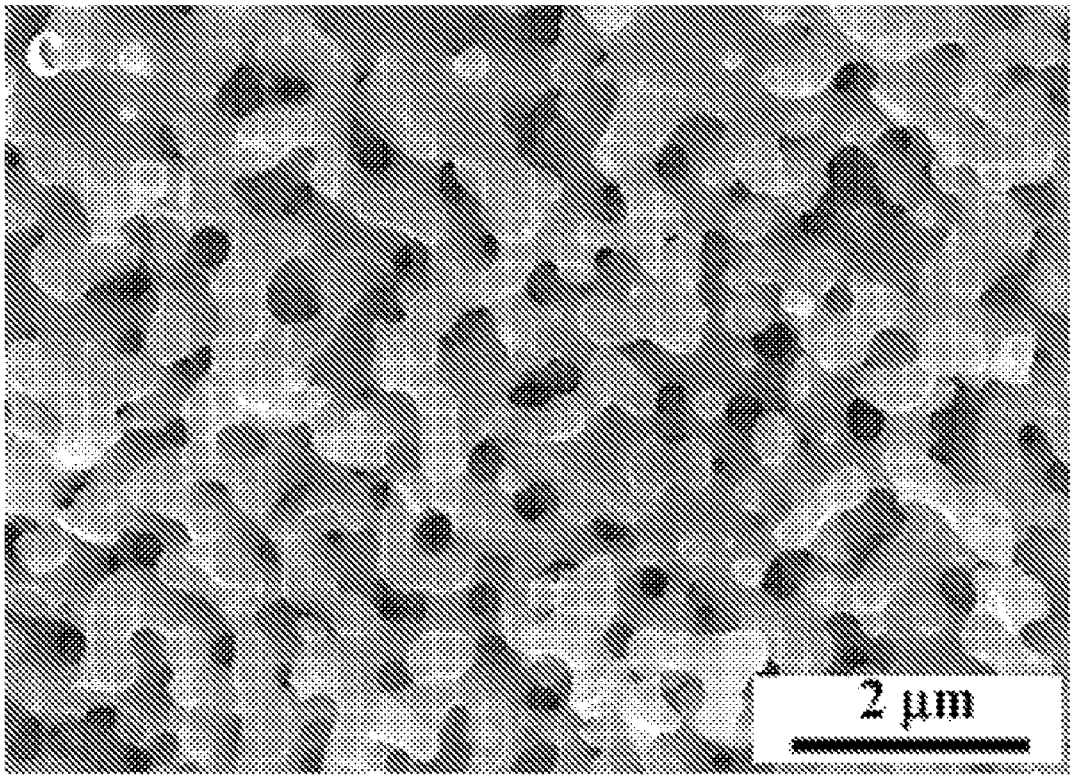
FIG. 13C is a SEM image of the fractured ribbon after de-alloying by immersion for 24 hours.

Results of the de-alloying of Ti-based alloys are illustrated in FIGS. 13A to 13C. The SEM images in FIG. 13A shows the surface of the $(Ti_{56}Al_{24}Co_{20})_{0.65}(Y_{56}Al_{24}Co_{20})_{0.35}$ specimen after de-alloying under a potential of 1.9V for 30 minutes. The pores shown as the black portions are uniformly distributed with a relatively uniform size in the range of from 50 nm to 200 nm.

The SEM image in FIG. 13B shows the surface of the ribbon after de-alloying under an applied voltage in the range of from 1.75 to 2.0V, as well as for a specimen entirely immersed in the 0.1M $HNO_3$ electrolyte for 24 hours. As illustrated in FIG. 13B, the pores shown in black are minutely distributed.

The SEM image in FIG. 13C shows a cross-section of a fractured ribbon after de-alloying by immersion in the 0.1M $HNO_3$ electrolyte for 24 hours. As shown in the SEM image of FIG. 13C, a plurality of pores are formed.

Figure 14:
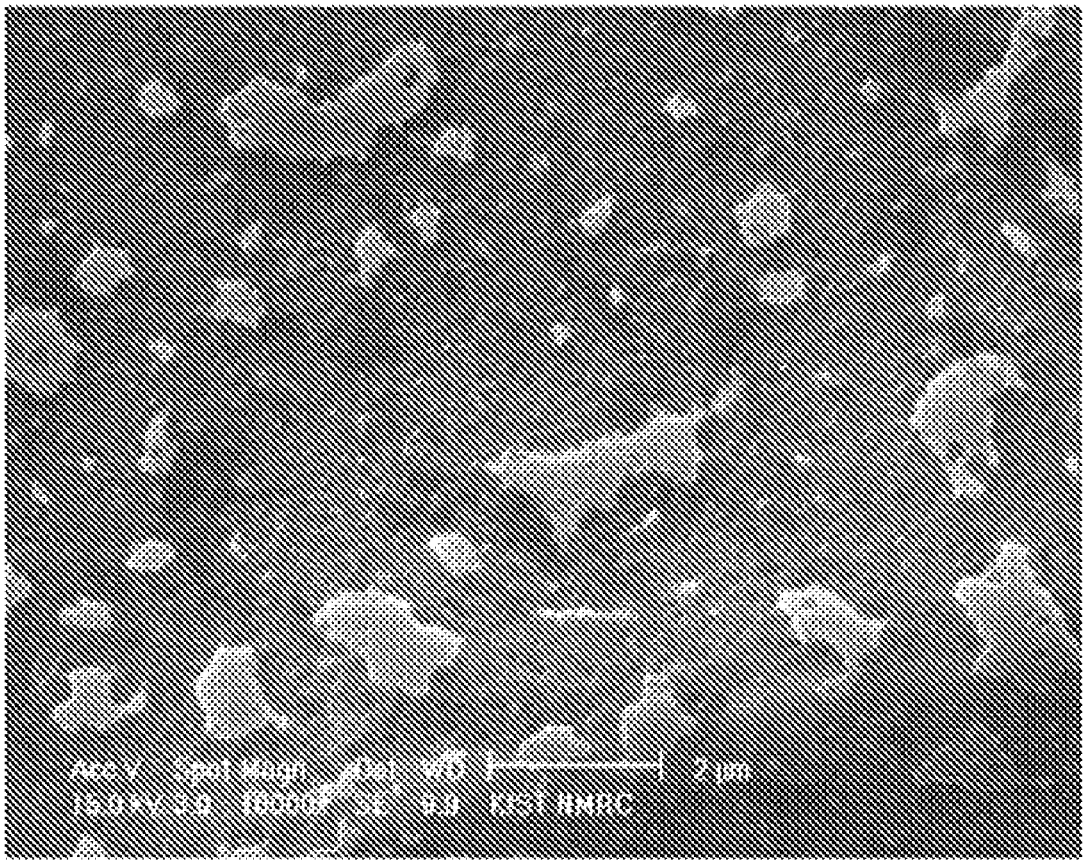
FIG. 14 is a SEM image of a $(Ti_{56}Al_{24}Co_{20})_{0.8}(Y_{56}Al_{24}Co_{20})_{0.2}$ specimen after de-alloying.

FIG. 14 shows a SEM image of the $(Ti_{56}Al_{24}Co_{20})_{0.8}(Y_{56}Al_{24}Co_{20})_{0.2}$ alloy. After the $(Ti_{56}Al_{24}Co_{20})_{0.8}(Y_{56}Al_{24}Co_{20})_{0.2}$ alloy was applied with a voltage of 1.9V, the de-alloying was not observed. This means that the $(Ti_{56}Al_{24}Co_{20})_{0.8}(Y_{56}Al_{24}Co_{20})_{0.2}$ alloy may represent the parting limit. When a ratio of the $Ti_{56}Al_{24}Co_{20}$ amorphous phase was 80%, the de-alloying was not observed.

Figure 15:
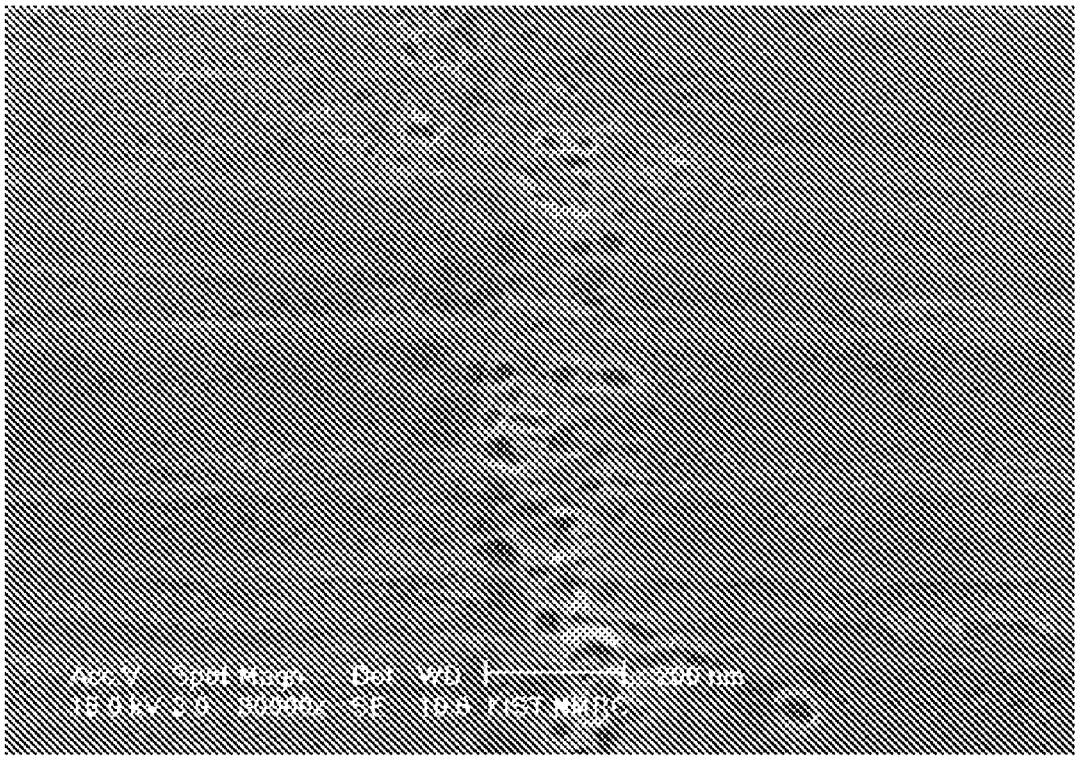
FIG. 15 is a SEM image of a $(Zr_{55}Al_{20}Co_{25})_{0.5}(Y_{56}Al_{24}Co_{20})_{0.5}$ specimen after de-alloying.

FIG. 15 shows the SEM image of the surface of the $(Zr_{55}Al_{20}Co_{25})_{0.5}(Y_{56}Al_{24}Co_{20})_{0.5}$ alloy which is a Zr-based metallic glass. As illustrated in FIG. 15, the pores are formed well at the surface of the $(Zr_{55}Al_{20}Co_{25})_{0.5}(Y_{56}Al_{24}Co_{20})_{0.5}$ alloy. Unlike the Ti—Y—Al—Co alloys, the Zr—Y—Al—Co alloy does not have a homogeneous pore size. Large pores in the center of the images can be observed together with small pores therearound. This wide irregular size distribution is believed to result from the initial non-homogeneity of the two-phase interconnected amorphous structure in the bulk specimen made of the Zr-based alloy.

Analyses of the Porous Metallic Glass

The chemical compositions of the porous metallic glass were analyzed by energy dispersive spectroscopy (EDS). The following Table 1 shows results of the EDS analysis. In comparison to the initial composition, the content of Y was largely reduced while the content of Ti increased. Meanwhile, contents of Al and Co are almost constant. Therefore, it was observed that the Y element in the amorphous phase was removed from the specimens. Nevertheless, some Y elements still remained, which can be explained by the secondary phase separation as explained below.

TABLE 1

| | Elements | | | |
|---|---|---|---|---|
| | Y | Ti | Al | Co |
| Initial composition | 20.0 at % | 36.0 at % | 24.0 at % | 20.0 at % |
| First specimen | 5.4 at % | 50.2 at % | 18.2 at % | 20.2 at % |
| Second specimen | 4.2 at % | 56.5 at % | 11.2 at % | 28.0 at % |

Measurement of the Surface Area

The surface area of the porous metallic glass was measured by means of the $N_2$ gas adsorption method. The BET (Brunauer-Emmett-Teller) method is the most acceptable technique for determining the surface area of solids by chemical adsorption of gases at their boiling temperatures. The basic equation for determining the surface area by the BET method is:

$$VSTP = Va/W \times [(273.15/(273.15+Ta)] \times Pa/760 \text{ mmHg} \quad \text{[Equation 1]}$$

$$Vm = VSTP \times (1 - P/Po)$$

$$S.A = Vm/22414 \times 6.023 \times 10^{23} \times Am$$

where

Va=Volume of adsorbate at ambient conditions (ml),

VSTP=Volume of adsorbate ($N_2$) at Standard Temperature and Pressure (STP), (ml/g of sample), Vm=Volume of the monolayer (ml), Ta=ambient temperature (° C.), Pa=ambient pressure (mmHg), P=absolute pressure of $N_2$ (mmHg), Po=saturated vapor pressure of adsorbate ($N_2$) at its boiling point (mmHg), S.A=surface area ($m^2$/g), Am=cross sectional area of $N_2$ molecule ($m^2$/molecule), and W=sample weight (g).

In the experimental example of the present invention, the BET surface area was measured using a Micromeritics-Autochem 2920 unit by $N_2$ adsorption at liquid nitrogen temperature, i.e., at −196° C. The porous samples were packed in a U-shaped tube and placed in the furnace of the unit. A pre-treatment process was carried out before the BET surface analysis. Helium gas was flowed over the sample at a temperature of about 150° C. and the temperature was maintained for at least for 30 minutes in order to remove any contaminants or moisture. Then, the sample was allowed to cool naturally at room temperature. After degassing the sample, a mixture of 30% $N_2$ and 70% He was applied to the sample, simultaneously using a Dewar flask of $LN_2$, the amount of $N_2$ adsorbed was measured, and immediately the amount of $N_2$ desorbed was measured and recorded by replacing the $LN_2$ Dewar flask by a water bath at ambient temperature. Equation 1 given above was used to measure the active surface area of the porous sample.

The value of the surface-to-volume aspect ratio for the $(Ti_{56}Al_{24}Co_{20})_{0.65}(Y_{56}Al_{24}Co_{20})_{0.35}$ porous sample was found to be 18 $m^2$/g. That value was near those reported for nanometer-sized porous materials.

Metallic glass according to the present invention has a small pore size, a large surface-volume aspect ratio, and a specific high strength. Therefore, the metallic glass can be used as a porous electrode for supporting a catalyst, a filter for fluids with large molecules, a porous biocompatible metallic alloy for the biomedical field, an insulating material, a sandwich-type structure for automobiles, and aerospace applications. Accordingly, the metallic glass can replace ceramic or polymer porous materials.

The porous metallic glass can find a wide range of applications from a fluid filter to catalytic substrates, and from a foam structure to biomedical implants.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A porous metallic glass comprising Ti (titanium) at 50.0 at % to 70.0 at %, Y (yttrium) at 0.5 at % to 10.0 at %, Al (aluminum) at 10.0 at % to 30.0 at %, Co (cobalt) at 10.0 at % to 30.0 at %, and impurities, wherein Ti+Y+Al+Co+the impurities=100.0 at %, wherein the glass comprises two or more separated and interconnected amorphous phases, and the first amorphous phase of the two or more amorphous phases is a $Ti_{56}Al_{24}Co_{20}$ amorphous phase and the second amorphous phase is a $Y_{56}Al_{24}Co_{20}$ amorphous phase.

2. The porous metallic glass of claim 1, wherein the $Ti_{56}Al_{24}Co_{20}$ amorphous phase is present in a range from 50.0 at % to 80.0 at % and the $Y_{56}Al_{24}Co_{20}$ amorphous phase is present in a range from 20.0 at % to 50.0 at %.

3. The porous metallic glass of claim 1, wherein a plurality of pores formed in the porous metallic glass are formed by removing Y elements from the $Y_{56}Al_{24}Co_{20}$ amorphous phase.

4. A porous metallic glass comprising Ti (titanium) at 50.0 at % to 70.0 at %, Y (yttrium) at 0.5 at % to 10.0 at %, Al (aluminum) at 10.0 at % to 30.0 at %, Co (cobalt) at 10.0 at % to 30.0 at %, and impurities, wherein Ti+Y+Al+Co+the impurities=100.0 at %, wherein pores formed in the porous metallic glass have sizes in a range from 10 nm to 500 nm.

* * * * *